United States Patent [19]

Svoboda

[11] 4,004,824

[45] Jan. 25, 1977

[54] GUIDE PLATE FOR SKI BINDINGS

[75] Inventor: Josef Svoboda, Schwechat, Austria

[73] Assignee: Gertsch AG, Zug, Switzerland

[22] Filed: Mar. 28, 1975

[21] Appl. No.: 562,895

[30] Foreign Application Priority Data

Mar. 29, 1974 Austria ..... 2650/74

[52] U.S. Cl. ..... 280/636

[51] Int. Cl.[2] ..... A63C 11/00

[58] Field of Search ..... 280/11.35 C, 11.35 K, 280/11.35 Y, 11.35 T, 11.35 A, 11.35 D, 11.35 E, 11.35 H, 11.35 R, 636, 617, 618, 611

[56] References Cited

UNITED STATES PATENTS

| | | | |
|---|---|---|---|
| 3,689,094 | 9/1972 | Marker et al. | 280/11.35 C |
| 3,806,144 | 4/1974 | Yans et al. | 280/11.35 C |
| 3,814,454 | 6/1974 | Beyl | 280/11.35 C |
| 3,905,906 | 9/1975 | Edmund | 280/11.35 C |

FOREIGN PATENTS OR APPLICATIONS

| | | | |
|---|---|---|---|
| 1,255,073 | 1/1961 | France | 280/11.35 C |
| 1,217,646 | 5/1960 | France | 280/11.35 C |
| 340,170 | 9/1959 | Switzerland | 280/11.35 C |

*Primary Examiner*—Philip Goodman
*Assistant Examiner*—Milton L. Smith
*Attorney, Agent, or Firm*—Woodhams, Blanchard and Flynn

[57] ABSTRACT

A guide plate assembly for use on skis in association with releasing ski bindings. The guide plate is composed of a mounting plate which is secured to the upper surface of a ski and has a low-friction material guide plate secured thereto and defining a support for the sole of a ski boot.

7 Claims, 7 Drawing Figures

FIG. 1
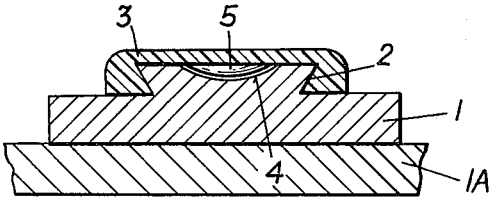
FIG. 2
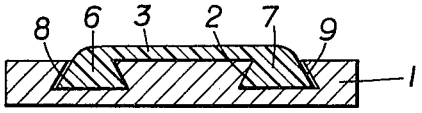
FIG. 3
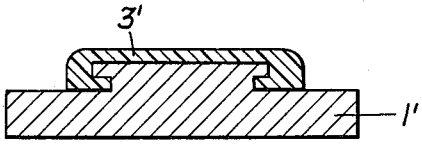
FIG. 4
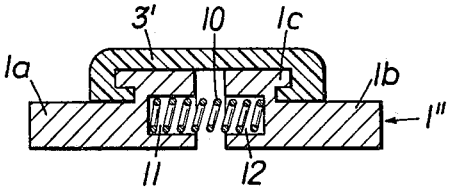
FIG. 5
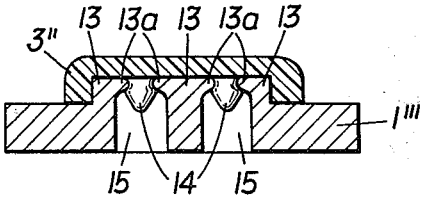
FIG. 6
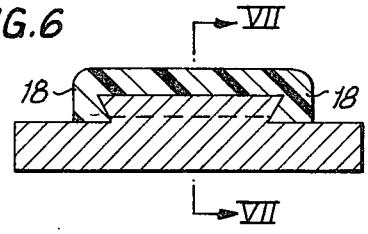
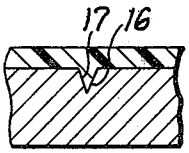
FIG. 7

GUIDE PLATE FOR SKI BINDINGS

FIELD OF THE INVENTION

The invention relates to a guide plate assembly for use between a ski boot sole and a ski surface in releasing ski bindings, comprising a mounting plate having a guide strip mounted on its upper surface, which mounting plate is secured on the ski surface.

BACKGROUND OF THE INVENTION

A guide plate of known construction has already been described in German OS No. 2,142,678 (corresponds to U.S. Pat. No. 3,814,454). Former guide plate constructions used to be secured to the ski by screws or an adhesive. The screw-type securement has the disadvantage that the screw heads — even if they originally lie lower than the surface of the guide disk — project from the guide strip after same is worn and can cause the boot sole to be caught. The use of adhesive alone is in the long run without effect in the case of guide strips which consist of a material with extremely advantageous sliding characteristics. A different type of fastening lies in a method, according to which a thin tetrafluoroethylene layer is melted onto an elastic carrier and the carrier is glued onto the ski surface. This construction has the disadvantages, according to the mentioned German OS No. 2,142,678, of being easily damaged by the heavy and rigid ski boots. A very thin guide layer is, during prolonged use affected disadvantageously by the riffles on the bottom of the boot sole, because the profiling will with time work itself into the guide surface and considerably reduce its sliding characteristics.

The teaching discussed in the German OS No. 2,142,678 circumvents the known disadvantages by having the guide plate rest in a large-surface mounting plate and be secured with its surface only slightly projecting above the upper side of the mounting plate, which upper side surrounds the guide plate.

This embodiment overcomes on the one hand the danger of damage to the guide plate, however, on the other hand it has the disadvantage that the wear of the guide plate is difficult to notice and, as a result, the boot sole no longer slides on the worn surface of the guide plate, but on the mounting plate. Since the sliding characteristics of the guide plate and of the mounting plate are substantially different, where worn guide plates are used, the desired objectives are no longer achieved.

In this connection, it must be emphasized particularly that the normal skier does not give enough attention to maintaining a perfect condition of his skiing equipment. Each man skilled in the art knows the consequences of poorly adjusted ski bindings. However, it cannot be expected that the normal nonexpert skier would pay particular attention to the small wear areas which are being created. Even the perfect operation in a new component may, after a certain amount of wear, have bad consequences on the slopes.

Here is where the invention becomes important. The invention has as its objective to produce a guide plate assembly which can be held simply and securely on a ski surface and the worn areas of which can easily be recognized.

The purpose of the invention is attained by the provision of a guide strip on a mounting plate, at least one of these component having at least one recess, for example, a groove, a riffle, a bore or the like and a locking element, for example a rib, a tooth, a head, a button or the like, which locking element engages said recess, whereby the superposed surfaces of the guide strip and mounting plate effect a still further locking function.

The inventive construction achieves, on the one hand a secure holding of the guide strip on or in the mounting plate and, on the other hand by using a locking device, an undesired shifting of the guide strip on the mounting plate in longitudinal direction of the cooperating locking elements is avoided.

According to a preferred embodiment of the invention, the engaging or joining parts of a recess and a holding element are of a dovetail-shaped construction. The recess lies advantageously in the guide strip and the holding element on the mounting plate. In this manner, it is possible to move the guide strip in a longitudinal direction onto the surface of the mounting plate, and a sliding out thereof is reliably avoided by the mentioned further locking device. A wear of the guide plate is indicated by the present construction with a sufficient amount of reliability, even if the sides would wear more than the center part.

A further objective of the invention consists in the guide strip having an arc-shaped extending surface being mounted caplike on the mounting plate. This embodiment constructs a particularly favorable guide surface, because the distorted support surface is less sensitive with respect to damages.

According to a different embodiment of the invention, snap pins are provided on one of the engaging elements, preferably on the guide strip, which snap pins cooperate with associated recesses of the other locking element, preferably in the mounting plate. In this case, the recesses are defined by ribbed brackets which in snapping-in direction have a certain flexibility, so that when the guide strip is pressed downwardly on the mounting plate they experience a self-deformation, however, after the receiving operation is finished, they hold the snap pins.

According to a further characteristic of the invention, several, advantageously three, holding devices of the recess and tongue type are used. In a further development of the objectives of the invention, the laterally extending holding devices are constructed oppositely compared with the center one. This construction results in a particularly secure locking arrangement.

According to a different objective of the invention, the locking device can consist of a recess which has a shape similar to a semisphere in the one surface and of an associated semispheric member on the surface of the other part. In this manner, after moving the guide plate onto the mounting plate, movement in a longitudinal direction of the holding device is avoided. A further number of similar locking devices can be used, the form of which may differ from a semisphere.

In a further embodiment of the invention, a projection which is positioned transversely to the holding device is provided as a locking device, which projection cooperates with a corresponding recess in the surface of the other part.

All of these locking devices are constructed inventively so that they assure an installation on the guide plate without a change in form of the same and/or of the mounting plate.

According to a still further characteristic of the invention, the mounting plate is constructed in two parts, the parts of which are pressed apart by a spring located between both parts, whereby the guide strip grips clamplike around the upper part of the mounting plate, which upper part has wings. This construction has the advantage, that during installation, the mounting plate may be pretensioned, so that the guide strip can be held without any additional locking device being required.

BRIEF DESCRIPTION OF THE DRAWING

Further advantages and details of the invention will be discussed more in detail in connection with the drawing, which illustrates several exemplary embodiments.

In the drawing:

FIG. 1 is a cross-sectional view of a first exemplary embodiment having a dovetail-shaped design;

FIG. 2 is a cross-sectional view of a modification of the embodiment of FIG. 1 having three dovetail-shaped mountings;

FIG. 3 is a cross-sectional view of an I-shaped mounting plate with arms of unequal length;

FIG. 4 is a cross-sectional view of an example for a divided mounting plate;

FIG. 5 is a cross-sectional view of a type of fastening means having a snap pin;

FIG. 6 is a cross-sectional view of a further embodiment; and

FIG. 7 is a sectional view taken along the line VII-VII of FIG. 6.

DETAILED DESCRIPTION

The conventional fastening means for securing a guide plate assembly to the ski 1A are not illustrated in the drawing.

The guide plate assembly is composed of a monolithic guide strip 3 (FIG. 1) made of low-friction material and having a dovetail-shaped locking recess therein and a mounting plate 1 having a dovetail-shaped locking element 2 thereon projecting upwardly from the upper surface thereof. It can easily be recognized that the guide strip 3 can be moved onto the dovetail-shaped locking element 2 on the mounting plate 1 perpendicular to the plane of the drawing. To avoid an undesired sliding out in this direction, an approximately semispherically-shaped recess 4 exists in the upper surface of locking element 2 on the mounting plate 1 which cooperates with a semispherically-shaped locking device 5 which is provided on the inner surface of the guide strip 3. It is to be recognized that both the number of the locking elements 2 or the number of locking devices 4, 5, which are here constructed as a projection recess combination, can be chosen as desired.

Another embodiment of a guide plate assembly is illustrated in FIG. 2. More specifically, the mounting plate has three side-by-side holding elements, the central one of which is approximately equal in shape to the locking element 2 illustrated in FIG. 1, the two lateral ones, however, are reversed, namely the guide strip 3 has extended dovetail-shaped ends 6, 7, which each engage one groove 8 or 9 in the mounting plate 1. Here too further locking devices can be used, however, these have not been separately illustrated.

FIG. 3 illustrates a modified form of the mounting plate 1'. The mounting plate 1' has a cross section which generally has an I shape and arms of unequal length. The lower part of the mounting plate 1' is secured to the ski and the upper part holds the differently designed guide strips 3' thereon. This rail-like fastening may be of a particular advantage, if large lateral forces are to be expected and if — in particular for reasons of the type of material used — the formation of dovetail-shaped parts are to be avoided. However, a further locking device, such as is shown in FIG. 1, can be used if desired.

A further exemplary embodiment is illustrated in FIG. 4. A divided mounting plate 1'' has two parts 1*a* and 1*b* which are symmetric with respect to the center line thereof. A space-maintaining spring 10 is inserted between the parts 1*a*,1*b*. The guide strip 3' may have, for example, the shape illustrated in FIG. 3 and the cross section of the mounting plate 1'' may have a cross section similar to the cross section of the mounting plate 1' illustrated in FIG. 3. This design is particularly advantageous for installation because, prior to the installation procedure, the two parts 1*a*,1*b* are compressed against the force of the spring 10 and the guide strip 3' is mounted thereover. After the parts 1*a*,1*b* are released, the mounting plate 1'' is mounted on the ski. In the illustrated embodiment, the opposite ends of the spring 10 are received in recesses 11 and 12 which are provided in the parts 1*a*,1*b*. This construction has the additional advantage, that the spring — assuming a sufficiently strong spring — presses the parts 1*a*,1*b* apart so strongly, that no additional locking device is necessary between the surface of the holding part 1*c* of the mounting plate 1' and the inner surface of the guide strip 3'.

FIG. 5 illustrates another embodiment of the invention in which ribbed brackets 13 are formed in the mounting plate 1''' which receive snap pins 14 secured to the guide strip 3''. The snap pins 14, as can be recognized from FIG. 5, have an enlarged head construction and a narrow neck portion. The neck portion is embraced by ribbed brackets 13 which are spaced a distance less than the size of the head. The ribbed brackets are advantageously manufactured of a material which has a resilient characteristic so that the snap pins 14 on the guide strip 3'' can be urged with pressure past the ribbed brackets 13. The flexibility characteristic can be accomplished, for example, through the provision of ribs 13*a* on the ribbed brackets 13 which are flexed downwardly during an insertion of the enlarged heads therepast. After the snap pins 14 have reached their position illustrated in FIG. 5, the ribs 13*a* of the ribbed brackets 13 move back into their original position and assume the position illustrated in FIG. 5. Through this, the guide strip 3'' is held securely on the mounting plate 1'''.

FIG. 6 illustrates a web 16 on the interior positioned transversely to the length of the guide strip and received in a corresponding indent 17 on the surface of the mounting plate. Dovetail-shaped ends 18 are provided on the guide strip and are identical to those illustrated in FIG. 1.

The invention is not limited to the illustrated exemplary embodiments. A number of variations exist, which lie within the scope of the claims. Thus, it is possible to vary the described exemplary embodiments among one another. However, it is also conceivable to combine the inventive device with other known devices, for example to secure the guide strip on the mounting plate in addition by gluing or screws.

Although particular preferred embodiments of the invention have been disclosed in detail for illustrative purposes, it will be recognized that variations or modification of the disclosed apparatus, including the rearrangement of parts, lie within the scope of the present invention.

The embodiments of the invention in which an exclusive property or privilege is claimed are defined as follows:

1. A guide plate assembly for use between a ski boot sole and a ski surface, comprising:

an elongated mounting plate secured to said ski surface and having first securement means integrally formed thereon and extending parallel to the longitudinal axis of said mounting plate and being exposed at the opposite ends of said mounting plate;

a monolithic guide strip made of low friction material and having second securement means integrally formed thereon and extending parallel to the longitudinal axis of said guide strip, said second securement means being initially coupled with said first securement means on said mounting plate, said guide strip thereafter being movable with respect to said mounting plate without distortion to said second securement means for assembly, said first and second securement means thereafter being cooperatively directly engaged with each other to effect a holding of said guide strip on said mounting plate;

said first securement means including an elongated first rib projecting upwardly on said mounting plate and having a dovetail shape;

said second securement means including means defining a pair of spaced and parallel second ribs which define a first recess therebetween, said recess having a dovetail cross section and receiving said first rib snugly therein, said dovetail-shaped rib and recess cooperatively holding said guide strip on said mounting plate;

wherein said first securement means includes a pair of elongated second recesses extending parallel to and on opposite sides of said first rib and having a dovetail cross section; and wherein said pair of parallel second ribs have a dovetail cross section and are each received in one of said elongated recesses.

2. A guide plate assembly according to claim 1, wherein part of the dovetailed cross section on each of said second ribs defines the dovetailed cross section of said first recess.

3. A guide plate assembly for use between a ski boot sole and a ski surface, comprising:

an elongated mounting plate secured to said ski surface and having first securement means integrally formed thereon and extending parallel to the longitudinal axis of said mounting plate and being exposed at the opposite ends of said mounting plate;

a monolithic guide strip made of low friction material and having second securement means integrally formed thereon and extending parallel to the longitudinal axis of said guide strip, said second securement means being initially coupled with said first securement means on said mounting plate, said guide strip thereafter being movable with respect to said mounting plate without distortion to said second securement means for assembly, said first and second securement means thereafter being cooperatively directly engaged with each other to effect a holding of said guide strip on said mounting plate; and locking means comprising at least one snap pin and at least one opening, said snap pin being provided on one of said guide strip and said mounting plate and said opening being provided on the other of said guide plate and said mounting plate, said snap pin having a diameter greater than said opening and at least one of said snap pin and said opening being made of a yieldable material to facilitate an insertion of said snap pin into said opening, said snap pin being received in said opening to effect said securement of said guide plate to said mounting plate against a relative vertical movement and also against a relative horizontal movement.

4. A guide plate assembly according to claim 3, wherein said snap pin is on said guide strip and said opening is on said mounting plate.

5. A guide plate assembly for use between a ski boot sole and a ski surface, comprising:

an elongated mounting plate secured to said ski surface and having first securement means integrally formed thereon and extending parallel to the longitudinal axis of said mounting plate and being exposed at the opposite ends of said mounting plate;

a monolithic guide strip made of low friction material and having second securement means integrally formed thereon and extending parallel to the longitudinal axis of said guide strip, said second securement means being initially coupled with said first securement means on said mounting plate, said guide strip thereafter being movable with respect to said mounting plate without distortion to said second securement means for assembly, said first and second securement means thereafter being cooperatively directly engaged with each other to effect a holding of said guide strip on said mounting plate;

said first securement means including an elongated first rib projecting upwardly on said mounting plate and having a pair of parallel recesses extending on opposite sides of said first rib;

said second securement means including a pair of spaced and parallel second ribs which define a recess therebetween, said second ribs extending toward each other and into said parallel recesses;

wherein said mounting plate is constructed in two parts so that said first rib is divided along a line parallel to said parallel recesses; and including at least one spring for urging said two parts apart to effect a snug reception of said second ribs in said parallel recesses to prevent both a vertical and horizontal relative movement between said mounting plate and said guide strip.

6. A guide plate assembly for use between a ski boot sole and a ski surface, comprising:

an elongated mounting plate secured to said ski surface and having first securement means integrally formed thereon and extending parallel to the longitudinal axis of said mounting plate and being exposed at the opposite ends of said mounting plate;

a monolithic guide strip made of low friction material and having second securement means integrally formed thereon and extending parallel to the longitudinal axis of said guide strip, said second securement means being initially coupled with said first securement means on said mounting plate, said guide strip thereafter being movable with respect to said mounting plate without distortion to said second securement means for assembly, said first and second securement means thereafter being cooperatively directly engaged with each other to effect a holding of said guide strip on said mounting plate; and locking means comprising a semispherical recess on one of said guide strip and said mounting plate and a semispherical projection on the other of said guide strip and said mounting plate, said semispherical projection being received in said semispherical recess to secure said guide strip to said mounting plate.

7. A guide plate assembly for use between a ski boot sole and a ski surface, comprising:

an elongated mounting plate secured to said ski surface and having first securement means integrally formed thereon and extending parallel to the longitudinal axis of said mounting plate and being exposed at the opposite ends of said mounting plate;

a monolithic guide strip made of low friction material and having second securement means integrally formed thereon and extending parallel to the longitudinal axis of said guide strip, said second securement means being initially coupled with said first securement means on said mounting plate, said guide strip thereafter being movable with respect to said mounting plate without distortion to said second securement means for assembly, said first and second securement means thereafter being cooperatively directly engaged with each other to effect a holding of said guide strip on said mounting plate; and locking means comprising at least one web integrally formed on one of said guide strip and said mounting plate and positioned transversely to the longitudinal axis thereof and a corresponding and parallel indent formed in the surface of the other of said guide strip and said mounting plate.

* * * * *